US006668434B2

(12) United States Patent
Casebolt et al.

(10) Patent No.: US 6,668,434 B2
(45) Date of Patent: Dec. 30, 2003

(54) HARNESS BUCKLE AND METHOD OF MAKING SAME

(75) Inventors: Scott C. Casebolt, St. Paul Park, MN (US); Barry J. Austin, Houston, TX (US)

(73) Assignee: D B Industries, Inc., Red Wing, MN (US)

( * ) Notice: Subject to any disclaimer, the term of this patent is extended or adjusted under 35 U.S.C. 154(b) by 0 days.

(21) Appl. No.: 10/144,686

(22) Filed: May 10, 2002

(65) Prior Publication Data

US 2002/0184742 A1 Dec. 12, 2002

Related U.S. Application Data

(60) Provisional application No. 60/289,991, filed on May 10, 2001.

(51) Int. Cl.[7] ..... A44B 11/25
(52) U.S. Cl. ..... 24/634; 24/265 BC
(58) Field of Search ..... 24/197, 265 BC, 24/265 EC, 633–639, 641–648, 650, 677, 662–664; 280/801.1, 802, 808; 297/286, 270, 468

(56) References Cited

U.S. PATENT DOCUMENTS

| | | | | | |
|---|---|---|---|---|---|
| 1,459,674 | A | * | 6/1923 | Jabner | 24/634 |
| 2,518,889 | A | * | 8/1950 | Henderson | 24/634 |
| 2,847,748 | A | * | 8/1958 | Robinton | 24/634 |
| 3,090,092 | A | * | 5/1963 | Szemplak et al. | 24/634 |
| 3,168,770 | A | * | 2/1965 | John, Jr. et al. | 24/634 |
| 3,201,840 | A | * | 8/1965 | Jantzen | 24/634 |
| 3,789,467 | A | * | 2/1974 | Aratani et al. | 24/634 |
| 4,101,171 | A | * | 7/1978 | Sasaki et al. | 297/389 |
| 4,307,494 | A | | 12/1981 | Gasse et al. | 24/230 |
| 4,321,734 | A | | 3/1982 | Gandelman | 24/230 |
| 4,534,087 | A | * | 8/1985 | Lau | 24/163 K |
| 4,587,695 | A | * | 5/1986 | Jensen | 24/634 |
| 5,033,171 | A | * | 7/1991 | Kasai | 24/614 |
| 5,419,020 | A | | 5/1995 | Murai | 24/625 |
| 5,561,891 | A | * | 10/1996 | Hsieh | 24/573.1 |
| 5,857,247 | A | | 1/1999 | Warrick et al. | 24/603 |
| 5,926,928 | A | * | 7/1999 | Lundstedt | 24/625 |

FOREIGN PATENT DOCUMENTS

| | | | | |
|---|---|---|---|---|
| GB | 2189540 | | 10/1987 | 11/25 |
| GB | 2 189 540 A | * | 10/1987 | 24/640 |

OTHER PUBLICATIONS

Photo 1(a), Front assembled view of COBRA buckle (Art. Nr. FC45B) by AustriAlpin Vertriebs GmbH of Tyrol, Austria (2000).

(List continued on next page.)

*Primary Examiner*—Robert J. Sandy
*Assistant Examiner*—Ruth C. Rodriguez
(74) *Attorney, Agent, or Firm*—IPLM Group, P.A.

(57) ABSTRACT

A buckle has a first outer plate, a second outer plate, and at least one intermediate plate sandwiched therebetween. Opposing first and second pawls are pivotally mounted between the first outer plate and the second outer plate, with respective force receiving portions projecting outward beyond a perimeter defined by the first outer plate and the second outer plate and extending away from one another. The pawls also have respective latching portions disposed between the first outer plate and the second outer plate and extending toward one another. First and second springs are interconnected between the at least one intermediate plate and respective pawls in a manner that biases the latching portions of the pawls to pivot toward one another. A catch has a strap supporting portion that is sized and configured for connection to a strap, and a distal portion that is sized and configured for insertion between the pawls and engagement between the latching portions. The arrangement is such that both force receiving portions must be moved toward the strap supporting portion to free the distal portion from between the pawls.

28 Claims, 4 Drawing Sheets

OTHER PUBLICATIONS

Photo 1(b), Front disassembled view of COBRA buckle (Art. Nr. FC45B) by AustriAlpin Vertriebs GmbH of Tyrol, Austria (2000).

Photo 1(c), Back disassembled view of COBRA buckle (Art. Nr. FC45B) by AustriAlpin Vertriebs GmbH of Tyrol, Austria (2000).

Photo 2(a), Front assembled view of buckle by International Safety Components Ltd. of Wales, U.K. (2000).

Photo 2(b), Front disassembled view of buckle by International Safety Components Ltd. of Wales, U.K. (2000).

Photo 2(c), Back disassembled view of buckle of International Safety Components Ltd. of Wales, U.K. (2000).

Photo 3(a), Front assembled view of CLICK FIX buckle (Art. Nr. 971501 & 971503) by Stubai GmbH of Tyrol, Austria (2000).

Photo 3(b), Front disassembled view of CLICK FIX buckle (Art. Nr. 971501 & 971503) by Stubai GmbH of Tyrol, Austria (2000).

Photo 3(c), Back disassembled view of CLICK FIX buckle (Art. Nr. 971501 & 971503) by Stubai GmbH of Tyrol, Austria (2000).

Photo 4(a), Front assembled view of Standard Click Lock buckle (Part Nos. 0383 & 0384) by Makefast Limited of Newtown, U.K. (2000).

Photo 4(b), Front disassembled view of Standard Click Lock buckle (Part Nos. 0383 & 0384) by Makefast Limited of Newtown, U.K. (2000).

Photo 4(c), Back disassembled view of Standard Click Lock buckle (Part Nos. 0383 & 0384) by Makefast Limited of Newtown, U.K. (2000).

Photo 5(a), Front assembled view of Fibula Velox buckle (Art. Code L22045) by Climbing Technology Limited of London, U.K. (2000).

Photo 5(b), Front disassembled view of Fibula Velox buckle (Art. Code L22045) by Climbing Technology Limited of London, U.K. (2000).

Photo 5(c), Back disassembled view of Fibula Velox buckle (Art. Code L22045) by Climbing Technology Limited of London, U.K. (2000).

* cited by examiner

HARNESS BUCKLE AND METHOD OF MAKING SAME

This application claims benefit of provisional Ser. No. 60/289,991, filed May 10, 2001, entitled "Harness Buckle and Method of Making Same".

FIELD OF THE INVENTION

The present invention relates to buckles, and may also be described in terms of methods and apparatus for interconnecting first and second straps on a harness of the type that is commonly worn for fall-arrest purposes.

BACKGROUND OF THE INVENTION

Buckles are well known in the art and prevalent in a variety of applications. An object of the present invention is to provide an improved buckle, preferably of a type that is suitable for use on fall-arrest harnesses worn by persons who work at dangerous heights.

SUMMARY OF THE INVENTION

In a preferred application, the present invention provides methods and apparatus for interconnecting the distal ends of first and second harness straps. Many features and/or advantages of the present invention will become more apparent from the detailed description that follows.

BRIEF DESCRIPTION OF THE DRAWINGS

With reference to the Figures of the Drawing, wherein like numerals represent like parts and assemblies throughout the several views.

DETAILED DESCRIPTION OF THE PREFERRED EMBODIMENT

Figure 1:
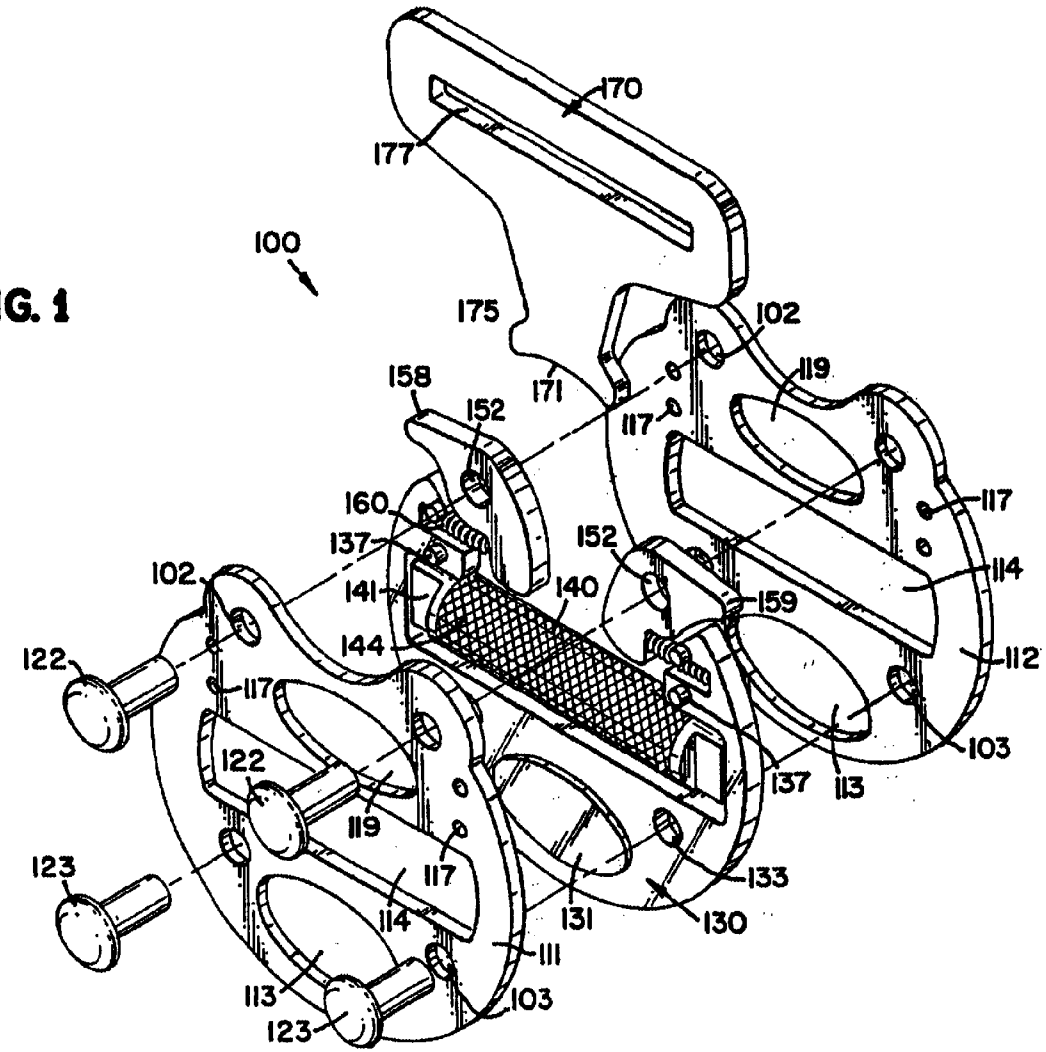
FIG. 1 is an exploded perspective view of a preferred embodiment buckle constructed according to the principles of the present invention.
Figure 2:
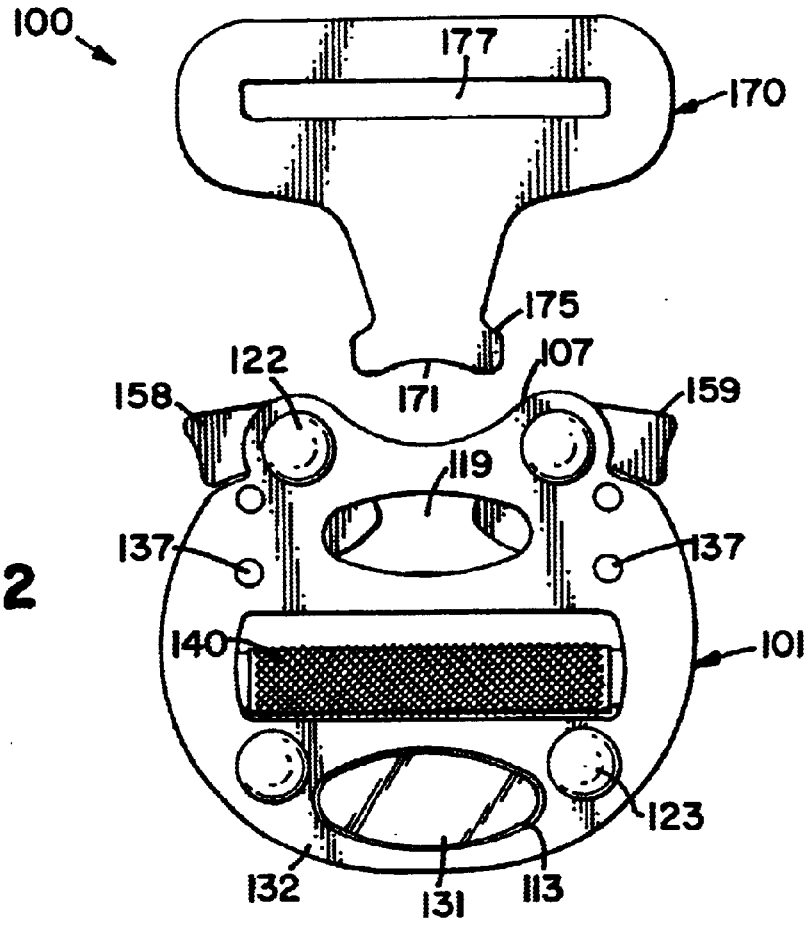
FIG. 2 is a front view of the buckle of FIG. 1, showing the buckle in an unlatched configuration.
Figure 3:
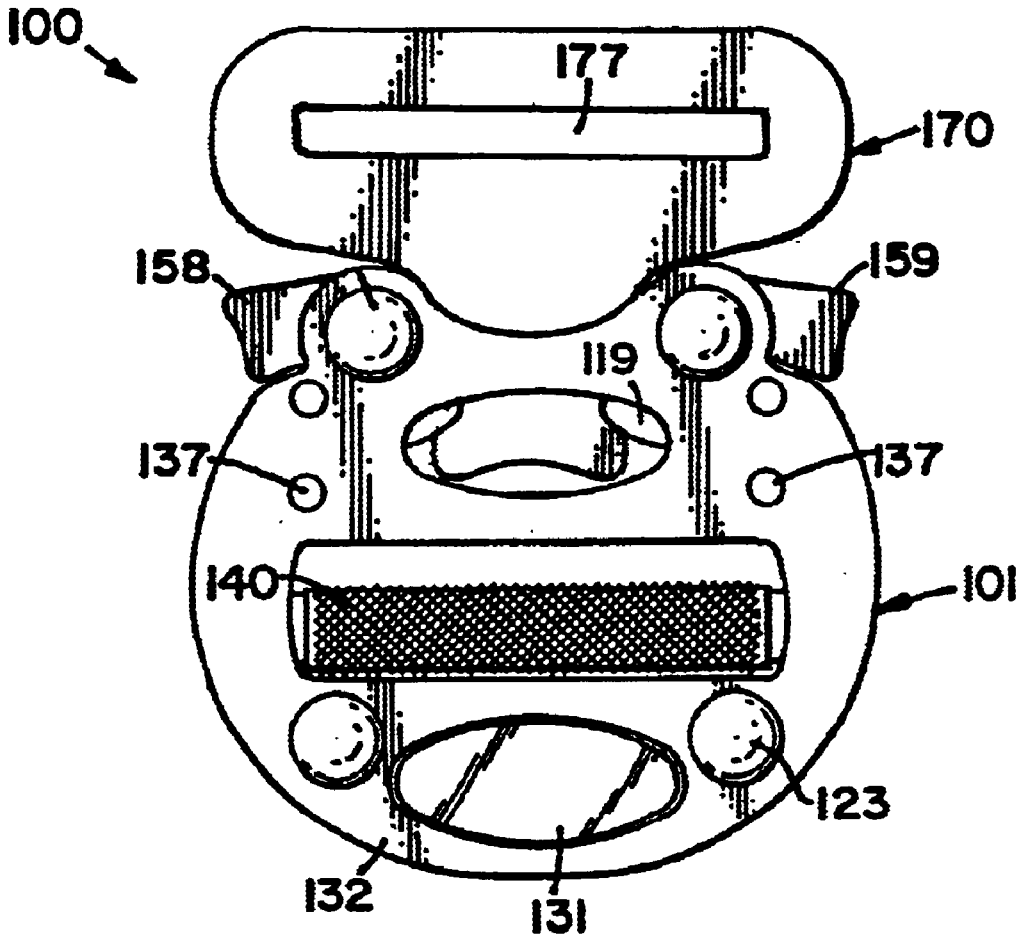
FIG. 3 is a front view of the buckle of FIG. 1, showing the buckle in a latched configuration.

A preferred embodiment buckle constructed according to the principles of the present invention is designated as 100 in FIGS. 1–3. The buckle 100 generally includes a first member or housing 101 and a second member or catch 170. In operation, a first harness strap is secured to the housing 101 in a manner already known in the art, and a second harness strap is secured to the catch 170 is a manner already known in the art. The catch 170 is releasably latched to the housing 101 in order to releasably connect the two harness straps to one another.

The housing 101 includes first and second outer plates 111 and 112 that are preferably made identical to one another for purposes of manufacturing efficiency. At least one intermediate plate 130 is sandwiched between the outer plates 111 and 112. The outer plates 111 and 112 are preferably made of steel, and the at least one intermediate plate 130 is preferably made of nylon plastic. Four registration pegs 137 project outward from each side of the intermediate plate(s) 130 and align with respective registration holes 117 in a respective outer plate 111 or 112. An elliptical boss 131 may also be provided on each side of the at least one intermediate plate 130 to align with similarly shaped openings 113 in respective outer plates 111 and 112. Rivets 123 extend through respective holes 103 in one outer plate 111, then through respective holes 133 in the intermediate plate(s) 130, and then through respective holes 103 in the other outer plate 112.

Figure 4:
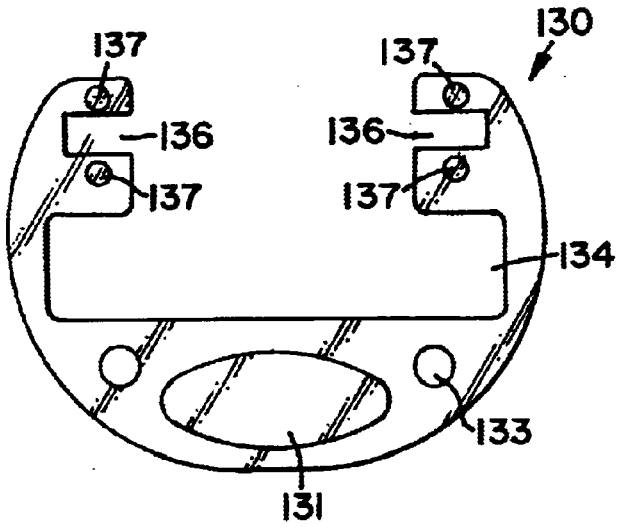
FIG. 4 is a front view of an intermediate plate on the buckle of FIG. 1.

The housing 101 includes a buckle slide 140 that is preferably made of steel and has a cylindrical middle portion 144 and flat ends 141. As shown in FIG. 4, the at least one intermediate plate 130 has a central opening 134 that is sized and configured to accommodate the entire slide 140. Also, each of the outer plates 111 and 112 has a relatively smaller rectangular opening 114 that is sized and configured to accommodate the middle portion 144 of the slide 140. The thickness of the intermediate plate(s) 130 is greater than the thickness of the ends 141, so the ends 141 of the slide 140 are movably retained between the outer plates 111 and 112. The slide bar 140 cooperates with the openings 114 in the plates 111 and 112 to retain the end of a harness strap. The middle portion 144 may be knurled to increase friction between the bar 140 and the strap.

The at least one intermediate plate 130 also has opposing slots 136 that are sized and configured to accommodate respective springs 160 between the outer plates 111 and 112. The springs 160 are helical coils that are compressed between respective end walls of respective slots 136, and respective bearing surfaces on respective pawls 158 and 159. Rivets 122 extend through respective holes 102 in one outer plate 111, then through respective holes 152 in respective pawls 158 and 159, and then through respective holes 102 in the other outer plate 112. The pawls 158 and 159 are preferably made of steel and sized to be thinner than the intermediate plate(s) 130. As a result, the pawls 158 and 159 are pivotally mounted between the outer plates 111 and 112.

The pawls 158 and 159 have respective latching portions that are biased toward one another by respective springs 160. This inward pivoting of the pawls 158 and 159 is limited by contact between the pawls 158 and 159 and respective portions of the intermediate plate(s) 130. The pawls 158 and 159 also have respective force receiving portions that project away from one another and outward beyond the perimeter of the outer plates 111 and 112. These force receiving portions or "wings" define bearing surfaces that face away from the catch 170 and in divergent fashion relative to one another.

The housing 101 has a "receiving" end 107 that is sized and configured to receive the catch 170. A "lead" end 171 of the catch 170 is configured for insertion into the housing 101 and between the pawls 158 and 159. More specifically, this "lead" end 171 of the catch 170 may be described as generally T-shaped, with recessed edges or shoulders 175 on opposite sides thereof. As the end 171 is inserted into the housing 101, it pushes the latching portions of the pawls 158 and 159 away from one another. Upon continued insertion of the end 171, the pawls 158 and 159 encounter the recessed edges 175 of the catch 170 and snap back toward one another (and behind the forwardmost portion of the catch 170). As shown in FIG. 3, inspection openings or windows 119 in the outer plates 111 and 112 allow a person to visually confirm that the pawls 158 and 159 have snapped into engagement with the catch 170. The catch 170 cannot thereafter by removed from the housing 101 unless both pawls 158 and 159 are rotated to respective "releasing" orientations. An opposite end of the catch 170 is provided with a slot 177 for purposes of retaining the end of a harness strap.

As a person uses his/her thumb and forefinger to urge respective force receiving portions to the pawls 158 and 159 away from the tab 132, the thumb and forefinger thereafter encounter the relatively wider portion of the catch 170 upon release of the catch 170 from the housing 101. This "transitional" arrangement facilitates both unlatching and removal of the catch 170 in one continuous motion.

Figure 5:
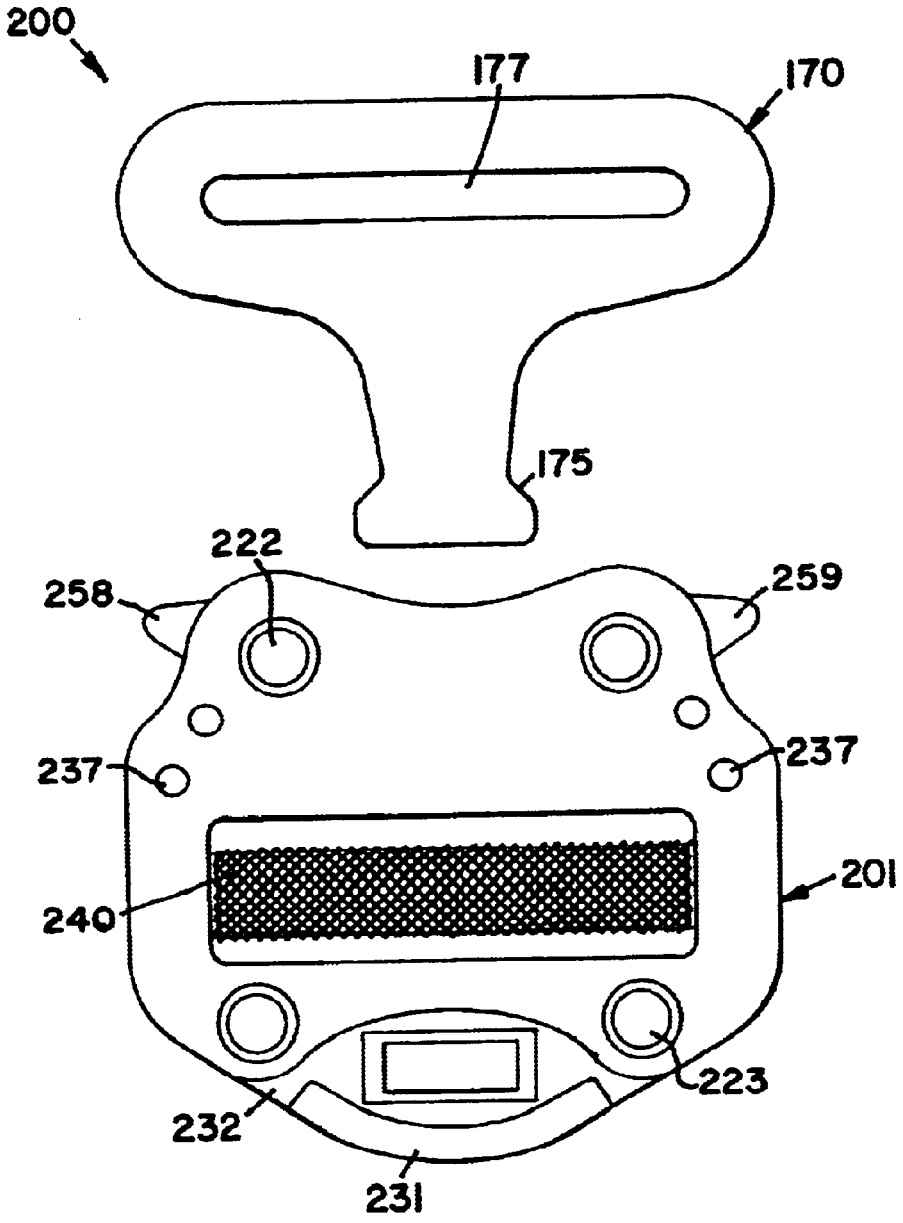
FIG. 5 is a front view of an alternative embodiment buckle constructed according to the principles of the present invention.

FIG. 5 shows an alternative embodiment buckle 200 constructed according to the principles of the present invention. The buckle 200 includes an identical catch 170 that is selectively latched between similar pawls 258 and 259 on an alternative housing 201. The housing 201 similarly includes at least one intermediate plate secured between first and second outer plates by means of rivets 222 and 223 (and registration pegs 237). Both the pawls 258 and 259 and a slide bar 240 are movably retained between the outer plates. Each of the outer plates on the housing 201 has an end opposite the catch 170 that is bounded by a concave edge, thereby defining a notch. The at least one intermediate plate has a "grippable" portion or tab 232 that spans the notch, and opposite facing sides of the tab 232 are bounded by an arcuate, peripheral ridge 231 that facilitates grasping of the housing 101.

Although the present invention has been described with reference to specific embodiments and a particular application, this disclosure will enable others to derive additional embodiments, improvements, and/or applications of the present invention. As a result, the scope of the present invention should be limited only to the extent of the following claims.

What is claimed is:

1. A buckle, comprising:

a first outer plate made of steel;

a second outer plate made of steel;

at least one intermediate plate made of plastic and sandwiched between the first outer plate and the second outer plate;

opposing first and second pawls pivotally mounted between the first outer plate and the second outer plate, wherein the pawls have respective latching portions disposed between the first outer plate and the second outer plate and extending toward one another, and respective force receiving portions projecting outward beyond a perimeter defined by the first outer plate and the second outer plate and extending away from one another;

first and second springs interconnected between the at least one intermediate plate and respective pawls in a manner that biases the latching portions of the pawls to pivot toward one another;

a catch having a strap supporting portion that is sized and configured for connection to a strap, and a distal portion that is sized and configured for insertion between the pawls and engagement between the latching portions in such a manner that both force receiving portions must be moved toward the strap supporting portion to free the distal portion from between the pawls; and further comprising a buckle slide having opposite ends slidably retained between the first outer plate and the second outer plate for sliding movement in a direction perpendicular to a longitudinal axis defined by the buckle slide, and an intermediate portion disposed inside relative openings in the at least one intermediate plate and each said other plate.

2. The buckle of claim 1, wherein the force receiving portions define respective bearing surfaces that face away from the strap supporting portion and in divergent fashion relative to one another.

3. The buckle of claim 1, wherein respective force receiving portions are sized and configured to guide a person's thumb and forefinger into engagement with respective portions of the strap supporting portion upon release of the distal portion from between the pawls.

4. The buckle of claim 1, wherein the latching portions are sized and configured to snap into respective notches in the distal portion.

5. The buckle of claim 1, wherein the latching portions must be pivoted away from one another to release the distal portion, and tensile force applied between the catch and the at least one intermediate plate urges the latching portions to pivot toward one another.

6. The buckle of claim 1, wherein registration pegs project outward from opposite sides of the at least one intermediate plate and into respective registration holes in the first outer plate and the second outer plate, respectively.

7. The buckle of claim 1, wherein rivets extend through respective holes in the first outer plate, then through respective pawls, and then through respective holes in the second outer plate.

8. The buckle of claim 1, wherein rivets extend through respective holes in the first outer plate, then through respective holes in the at least one intermediate plate, and then through respective holes in the second outer plate.

9. The buckle of claim 1, wherein an opening extends through at least one said outer plate to reveal interengaged portions of the catch and the pawls when the distal portion is latched between the latching portions of the pawls.

10. The buckle of claim 1, wherein a strap receiving opening extends through the intermediate plate and each said outer plate.

11. A buckle, comprising:

a first outer plate;

a second outer plate;

at least one intermediate plate sandwiched between the first outer plate and the second outer plate in such a manner that a grippable portion of the at least one intermediate plate projects outward from between the first outer plate and the second outer plate, and a strap receiving opening extends through the intermediate plate and each said outer plate;

opposing first and second pawls pivotally mounted between the first outer plate and the second outer plate, wherein the pawls have respective latching portions disposed between the first outer plate and the second outer plate and extending toward one another, and respective force receiving portions projecting away from one another and outward beyond a perimeter defined by the first outer plate and the second outer plate;

first and second springs interconnected between the at least one intermediate plate and respective pawls in a manner that biases the latching portions of the pawls to pivot toward one another; and a catch having a strap supporting portion that is sized and configured for connection to a strap, and a distal portion that is sized and configured for insertion between the pawls and engagement between the latching portions, wherein the force receiving portions define respective bearing surfaces that face away from the strap supporting portion.

12. The buckle of claim 11, wherein respective force receiving portions are sized and configured to guide a person's thumb and forefinger into engagement with respective portions of the strap supporting portion upon release of the distal portion from between the pawls.

13. The buckle of claim 11, wherein the distal end of the catch cooperates with the pawls to remain latched until both pawls are pivoted away from the catch.

14. A method of making a buckle, comprising the steps of:

providing a first outer plate;

providing a second outer plate;

sandwiching at least one intermediate plate between the first outer plate and the second outer plate in such a manner that a strap receiving opening is defined through the intermediate plate and each said outer plate, and a grippable portion of the intermediate plate projects outward from between the first outer plate and the second outer plate;

pivotally mounting first and second pawls between the first outer plate and the second outer plate in such a manner that the pawls are disposed on opposite sides of an opening defined between the first outer plate and the second outer plate, opposite the grippable portion of the intermediate plate;

biasing the pawls so that respective latching portions resist movement away from one another; and providing a catch with a strap supporting portion that is sized and configured for connection to a strap, and a distal portion that is sized and configured for insertion into the opening and between the latching portions.

15. The method of claim 14, wherein the first two providing steps involve making two identical plates.

16. The method of claim 14, wherein the grippable portion of the at least one intermediate plate is provided with at least one ridge that projects through an interface plane defined between the at least one intermediate plate and one said outer plate.

17. The method of claim 14, wherein the catch and the pawls are configured in such a manner that each of the pawls must be pivoted away from the catch in order to release the catch.

18. The method of claim 14, wherein at least one said outer plate is provided with a window to reveal interengaged portions of the catch and the pawls when the distal portion is latched between the latching portions.

19. A buckle, comprising:

a first outer plate;

a second outer plate, wherein an inspection opening extends through at least one said outer plate;

at least one intermediate plate sandwiched between the first outer plate and the second outer;

at least one pawl pivotally mounted between the first outer plate and the second outer plate;

a spring interconnected between the at least one intermediate plate and the at least one pawl in a manner that biases the at least one pawl toward a latching position; and a catch having a strap supporting portion that is sized and configured for connection to a strap, and a distal portion that is sized and configured for insertion between the first outer plate and the second outer plate and into engagement with the at least one pawl, wherein the inspection opening allows a person to see interengaged portions of the catch and the at least one pawl and thereby visually confirm that the catch is engaged by the at least one pawl.

20. The buckle of claim 19, wherein the first outer plate and the second outer plate are identical to one another.

21. The buckle of claim 19, wherein the inspection opening extends through each said outer plate.

22. The buckle of claim 19, wherein the at least one pawl includes first and second pawls that are configured and arranged to receive the catch therebetween.

23. The buckle of claim 22, wherein each of the pawls is partially visible through the inspection opening.

24. A buckle, comprising:

a first outer plate;

a second outer plate;

at least one intermediate plate sandwiched between the first outer plate and the second outer plate, wherein the intermediate plate is configured to define gaps between the first plate and the outer plate;

a buckle slide having opposite ends that occupy respective said gaps, and an intermediate portion that is accessible via respective openings in the at least one intermediate plate and each said outer plate;

opposing first and second pawls pivotally mounted between the first outer plate and the second outer plate in respective said gaps, wherein the pawls have respective latching portions disposed between the first outer plate and the second outer plate and extending toward one another, and respective force receiving portions projecting outward beyond a perimeter defined by the first outer plate and the second outer plate and extending away from one another;

first and second springs interconnected between the at least one intermediate plate and respective pawls in a manner that biases the latching portions of the pawls to pivot toward one another; and a catch having a strap supporting portion that is sized and configured for connection to a strap, and a distal portion that is sized and configured for insertion between the pawls and engagement between the latching portions in such a manner that both force receiving portions must be moved toward the strap supporting portion to free the distal portion from between the pawls.

25. The buckle of claim 24, wherein the opposite ends of the buckle slide have rectangular cross-sections when viewed from an end perspective.

26. The buckle of claim 24, wherein the opposite ends of the buckle slide are secured between the first outer plate and the second outer plate in a manner that prevents rotation relative thereto.

27. The buckle of claim 24, wherein each said outer plate is made of steel, and the at least one intermediate plate is made of plastic.

28. A buckle, comprising: a first outer plate made of steel; a second outer plate made of steel; at least one intermediate plate made of plastic and sandwiched between the first outer plate and the second outer plate; opposing first and second pawls pivotally mounted between the first outer plate and the second outer plate, wherein the pawls have respective latching portions disposed between the first outer plate and the second outer plate and extending toward one another, and respective force receiving portions projecting outward beyond a perimeter defined by the first outer plate and the second outer plate and extending away from one another; first and second springs interconnected between the at least one intermediate plate and respective pawls in a manner that biases the latching portions of the pawls to pivot toward one another; a catch having a strap supporting portion that is sized and configured for connection to a strap, and a distal portion that is sized and configured for insertion between the pawls and engagement between the latching portions in such a manner that both force receiving portions must be moved toward the strap supporting portion to free the distal portion from between the pawls; and an opening extends through at least one said outer plate to reveal interengaged portion of the catch and the pawls when the distal portion is latched between the latching portions of the pawls.

* * * * *

UNITED STATES PATENT AND TRADEMARK OFFICE

CERTIFICATE OF CORRECTION

PATENT NO. : 6,668,434 B2
DATED : December 30, 2003
INVENTOR(S) : Scott C. Casebolt and Barry J. Austin It is certified that error appears in the above-identified patent and that said Letters Patent is hereby corrected as shown below:

Column 2,
Line 63, delete "by" and insert therefore -- be --

Column 5,
Line 43, insert -- plate -- after the second occurrence of "outer".

Signed and Sealed this

Twelfth Day of October, 2004

JON W. DUDAS
*Director of the United States Patent and Trademark Office*